US005436713A

United States Patent [19]

Bigelow et al.

[11] Patent Number: 5,436,713

[45] Date of Patent: Jul. 25, 1995

[54] APPARATUS FOR REMOVING RESIDUAL DEVELOPER MATERIAL FROM A SURFACE OF A PRINTING MACHINE

[75] Inventors: Richard W. Bigelow; Douglas A. Lundy, both of Webster, N.Y.

[73] Assignee: Xerox Corporation, Stamford, Conn.

[21] Appl. No.: 109,767

[22] Filed: Aug. 20, 1993

[51] Int. Cl.[6] ..... G03G 21/00

[52] U.S. Cl. ..... 355/298; 355/302

[58] Field of Search ..... 355/296, 298, 301, 302, 355/303, 304

[56] References Cited

U.S. PATENT DOCUMENTS

| | | | |
|---|---|---|---|
| 3,842,273 | 10/1974 | Van Buskirk | 250/324 |
| 3,883,292 | 5/1975 | Hamaker | 355/290 X |
| 3,932,910 | 1/1976 | Shimoda | 355/304 X |
| 4,050,413 | 9/1977 | Parker | 355/253 X |
| 4,078,929 | 3/1978 | Gundlach | 96/1.2 |
| 4,172,303 | 10/1979 | Wooding et al. | 15/256.52 |
| 4,213,794 | 7/1980 | Wooding et al. | 134/6 |
| 4,361,922 | 12/1982 | Karal | 355/303 X |
| 4,533,236 | 8/1985 | Garsin | 355/15 |
| 4,588,285 | 5/1986 | Tagoku | 355/298 |
| 4,615,613 | 10/1986 | Garsin | 355/15 |
| 4,673,284 | 6/1987 | Matsumoto et al. | 355/301 |
| 5,153,642 | 10/1992 | Folkins et al. | 355/215 |
| 5,175,590 | 12/1992 | Frankel et al. | 355/296 |
| 5,268,723 | 12/1993 | Kikuchi | 15/256.51 X |

OTHER PUBLICATIONS

Neu R. Lindblad et al., "Dual Electrostatic Brush Cleaner For Cleaning Multiple Toner Types", *Xerox Disclosure Journal,* vol. 15, No. 6, Nov./Dec. 1990, pp. 463–466.

Bruce W. Friday, "Device For Reducing Brush Fiber Matting in Xerographic Cleaning System," *Xerox Disclosure Journal,* vol. 1, No. 6, Jun. 1976, p. 85.

*Primary Examiner*—Fred L. Braun

*Attorney, Agent, or Firm*—Gary B. Cohen

[57] ABSTRACT

A cleaning apparatus for removing residual developer material remaining on a surface of a printing machine is provided. The cleaning apparatus includes a movable cleaning brush having bristles. The brush is positioned adjacent to the surface so that as the movable brush is moved, the bristles contact the surface and the residual developer material is removed therefrom. A detoning device is positioned adjacent to the movable cleaning brush in a manner that permits the bristles to contact the detoning device as the movable cleaning brush is moved. The detoning device includes a plurality of hook-like and/or teeth-like members which dislodge the residual developer material from the bristles as they contact the hook-like members.

13 Claims, 7 Drawing Sheets

APPARATUS FOR REMOVING RESIDUAL DEVELOPER MATERIAL FROM A SURFACE OF A PRINTING MACHINE

The present invention relates generally to a cleaning apparatus for a printing machine, and, more specifically, to a detoning apparatus which facilitates removal of adherent developer material and developer material additives from the bristles of a cleaning brush.

In electrophotographic applications such as xerography, a charge retentive surface is electrostatically charged and exposed to a light pattern of an original image to be reproduced for selectively discharging the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development and transfer, excess toner left on the charge retentive surface is cleaned from the surface. The process is well known, and useful for light lens copying from an original, and printing applications from electronically generated or stored originals, where a charged surface may be imagewise discharged in a variety of ways.

Although a preponderance of the toner forming the image is transferred to the paper during transfer, some toner invariably remains on the charge retentive surface, it being held thereto by relatively high electrostatic and/or mechanical forces. A commercially successful mode of cleaning employed in automatic xerography utilizes a brush with soft fiber bristles which have suitable triboelectric characteristics. While the bristles are soft they are sufficiently firm to remove residual toner particles from the charge retentive surface. In addition, webs or belts of soft fibrous or tacky materials and other cleaning systems are known.

As disclosed by the following patents, fibers or hook-like members, commonly referred to as Velcro ("Velcro" is a trademark of Velcro Industries B. V.), have been used to facilitate cleaning in printing machines:

U.S. Pat. No. 3,842,273 Patentee: Van Buskirk Issued: Oct. 15, 1974

U.S. Pat. No. 5,153,642 Patentee: Folkins et al. Issued: Oct. 6, 1992.

U.S. Pat. No. 3,842,273 discloses an apparatus for cleaning a corona generator. The corona generator includes a shield, a portion of which is preferably cleaned with a movable brush. In one example the brush is constructed with hook-like members.

U.S. Pat. No. 5,153,642 is directed toward a fiber cleaning system for a development system. The fiber cleaning system, which includes a plurality of hook-like members mounted on a support, is installed removably in a development station. In operation, developer material flows through the hook-like members so that contaminants are trapped thereby.

A process referred to as "highlight color imaging" has been accomplished by employing basic xerographic techniques. The concept of tri-level, highlight color xerography is described in the following patent:

U.S. Pat. No. 4,078,929 Patentee: Gundlach Issued: Mar. 14, 1978

U.S. Pat. No. 4,078,929 discloses the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as is the case in conventional xerography. The photoreceptor is charged, typically to −900 volts, and exposed imagewise, such that one image corresponding to charged image areas (which are subsequently developed by charged-area development, i.e. CAD) stays at the full photoreceptor potential ($V_{cad}$ or $V_{ddp}$). $V_{ddp}$ is the voltage on the photoreceptor due to the loss of voltage while the photoreceptor remains charged in the absence of light, otherwise known as dark decay. Another image is exposed to discharge the photoreceptor to its residual potential, i.e. $V_{dad}$ or $V_c$ (typically −100 volts), which $V_c$ corresponds to discharged area images that are subsequently developed by discharged-area development (DAD). The background area is exposed so as to reduce the photoreceptor potential to halfway between the $V_{cad}$ and $V_{dad}$ potentials, (typically −500 volts) and is referred to as $V_{white}$. The CAD developer is typically biased about 100 volts closer to $V_{cad}$ than $V_{white}$ (about −600 volts), and the DAD developer system is biased about 100 volts closer to $V_{dad}$ than $V_{white}$ (about −400 volts). As will be appreciated, the highlight color need not be a different color but may have other distinguishing characteristics. For example, one toner may be magnetic and the other non-magnetic.

It is generally well known how to control and adjust particular parameters of an electrophotographic printing machine. For example, individual control signals can be used to adjust operating elements of a printing machine, such as controlling development by control of the ratio of toner particles to carrier granules in the developer material and the electrical bias applied to the developer roller. Other control techniques compare a signal measuring the reflected light from a clean photoconductive member to a signal reflected from a developed test patch formed thereon. The resultant error signal regulates toner dispensing to control the concentration of toner particles in the developer material on the photoconductive surface. Generally, the density of the developer material developed on the test patch is monitored by an infrared densitometer. In various applications, the photoreceptive member includes at least two document zones and an interdocument zone disposed therebetween. Preferably, an image from a document is developed in the document zone while the test patch is developed in the interdocument zone. Typically, the test patch is formed in the interdocument zone so as not to interfere with imaging in the document zone.

Ineffective cleaning can be encountered when a test patch is formed in the interdocument zone. That is, while much of the toner is removed from the document zone during the transfer stage, all of the toner comprising the test patch remains in the interdocument zone right up until the cleaning stage. Moreover, commonly during transfer and detack, the document and interdocument zones are not charged to the same polarity levels. Indeed, these zones can even possess opposing polarities. The following references disclose systems adapted to clean a belt with zones of varying toner density:

U.S. Pat. No. 4,533,236 Patentee: Garsin Issued: Aug. 6, 1985

U.S. Pat. No. 4,615,613 Patentee: Garsin Issued: Oct. 7, 1986

U.S. Pat. No. 5,175,590 Patentee: Frankel et al. Issued: Dec. 29, 1992

U.S. Pat. No. 4,615,613 discloses a cleaning brush having different biases applied thereto in accordance the area of the charge retentive surface being cleaned. Preferably, when toner is being removed from the document area of the charge retentive surface, one bias level is applied and when the interdocument area is being cleaned a different bias is applied.

U.S. Pat. No. 5,175,590 discloses a technique for removing developer material from document and interdocument zones of a photoreceptor by changing an applied current level of a corona generating device as the zones are passed thereby. In particular, corona generating devices are switched between voltage levels to facilitate optimal cleaning of developer material residue from the document and interdocument zones.

Ineffective cleaning can also be encountered with a typical highlight color apparatus when toners of varying triboelectric characteristics are employed. For example, as explained in the following disclosure, it may be desirable to employ two electrostatic brushes with differing polarities to remove toners of differing preferences:

Lindblad, L. R. and Pozzanghera, D. L.

Dual Electrostatic Brush Cleaner for Cleaning Multiple Toner Types

Xerox Disclosure Journal, Vol. 15, No 6 at pp. 463–466 Published: November/December 1990

Even for those circumstances in which toner is effectively removed from the photoreceptor with one or more cleaning brushes, the brushes can become "choked" as a result of the excessive amount of toner being delivered thereto. In an attempt to avoid choking, toner is typically removed from the bristles of each brush by way of "detoning". Established practices to detone fiber brushes include, but are not limited to: (a) overcoming electrostatic adhesion forces with a suitable air pressure differential, (b) knocking toner from fibers with a mechanical stop or a "flicker bar", (c) using biased detoning rolls to counter or oppose electrostatic forces greater than the adhesion forces and d) increasing brush speed so that the radial centrifugal force for toner detachment overcomes electrostatic adhesion force. Two other approaches to detoning are disclosed in the following references:

U.S. Pat. No. 4,172,303 Patentee: Wooding et al. Issued Oct. 30, 1979

U.S. Pat. No. 4,213,794 Patentee: Wooding et al. Issued: Jul. 22, 1980

Friday, B. W. Device for Reducing Brush Fiber Matting in Xerographic Cleaning System Xerox Disclosure Journal, Vol. 1, No. 6 at p. 85 Published: June 1976

U.S. Pat. Nos. 4,172,303 and 4,213,794 disclose a cleaning system with a cleaning brush that is adapted to remove toner from a photoconductive member as the brush is rotated about its central axis. The cleaning brush is in contact with a rotatable "comb", the comb including a rotatable shaft with bristles that engage the nap of the cleaning brush. The bristles of the comb are arranged in screw-type segments so that they traverse the nap of the cleaning nap as the rotatable shaft is rotated and dislodge toner from the cleaning brush. The dislodged toner is directed by auger action toward a duct where it is removed by use of a vacuum source.

The Xerox Disclosure Journal reference of Friday ("Friday Reference") teaches that matting, clumping or fusing of cleaning brush fibers can be alleviated by detoning a cleaning brush with a flicker bar with a comb-like member engaging the brush. Alternatively, the comb-like member can be used in conjunction with a conventional flicker bar.

Cleaning of developer material from a photoreceptive surface can be further complicated when particulate and/or film forming additives, such as zinc stearate ("ZnSt") and/or aerosil ($Si\ O_2$) are added to the developer material. In highlight color printing, ZnSt and aerosil, among other additives, are added to color toner as flow, admix and charge control agents. It has been found that when ZnSt, for example, is used to control developer properties, deposition of these additives can occur on the photoreceptor and cause undesirable effects. For example, a CAD loss deletion can occur when a charged area passes through a DAD (Color) housing, thus resulting in partial discharge of the charged area and causing loss of image resolution. Furthermore, print quality defects can occur when a developed color image is passed through a CAD (Black) housing in that mechanical action of the circulating black "Mag" brush developer can physically shift (i.e. push) the color toner on the photoreceptor. This "image push" may be attributed to a reduction in friction (adhesion) between the color tone and the photoreceptor due to the presence of a ZnSt film.

In the 4850 highlight color printer manufactured by Xerox® Corporation, some of the above-discussed undesirable effects attributed to the use of additives in the developer material is alleviated through use of a teflon ("teflon" is a trademark of E. I. Du Pont de Nemours & Co.) coated flicker bar in conjunction with a vacuum exhaust. The teflon coating of the flicker bar tribo-charges the bristles or fibers of the cleaning brush(es) positively. This tribo-charging has been found effective in promoting cross-mixing of in-coming black toner along the brush(es). This cross-mixing uniformly tones the brushes with black toner which inhibits additive filming of the photoreceptor in non-imaged or background areas.

Cleaning of developer material from a photoreceptive surface can be even further complicated when fibers of the cleaning brush become matted. In particular, the fibers of an insulative cleaning brush are intended to function independently so that continuous cleaning action can be achieved across the breadth of the photoreceptor. Experience has shown, however, that the fibers can stick together and the brush can become matted. Such undesirable behavior can result in gaps in a desired cleaning zone so that residual toner and other debris escapes removal from the photoreceptor.

Difficulties in cleaning can arise when a conventional brush is used to detone a cleaning brush. For example, when large quantities of toner are delivered to the cleaning station of a printing machine, as is often the case with the 4850 highlight color printer, the detoning brush can become clogged or choked readily. It would be desirable to provide a detoning device that is particularly suited for detoning a cleaning brush which removes relatively large amounts of toner from the photoreceptor.

While the teflon-coated flicker bar has been found to be adequate in removing developer additives from a cleaning, under certain circumstances, the coated flicker bar does not remove sufficient levels of the developer additives from the cleaning brush bristles. Accordingly, problems resulting from insufficient removal of developer additives can arise. For example, use of the coated flicker bar is partially ineffective when high vacuum exhaust selectively depletes black toner from the brush fibers. Additionally, the flicker bar is ineffective if black toner is not used. While a special black tone protocol can be used to periodically coat the fibers, when the black toner developer is disabled, the additional time required to perform these protocols is inconvenient to the user of the printer. It has been found that scraping developer additives off the cleaning brush bristles with a comb, as suggested by the Friday Reference, is appropriate for developer additive removal, provided the comb is suitably configured. Unfortunately, the Friday Reference provides no teaching as to how a detoning comb should be configured to maximize developer additive removal. It would be desirable to provide a detoning comb which is configured to maximize developer additive removal.

In accordance with the present invention there is provided a cleaning apparatus for removing residual developer material remaining on a surface of a printing machine. The cleaning apparatus includes a movable cleaning brush having bristles. The brush is positioned adjacent to the surface so that as the movable brush is moved, the bristles contact the surface and the residual developer material is removed therefrom. A detoning device is positioned adjacent to the movable cleaning brush in a manner that permits the bristles to contact the detoning device as the movable cleaning brush is moved. The detoning device includes a plurality of hook-like members which dislodge the residual developer material from the bristles as they contact the hook-like members.

These and other aspects of the invention will become apparent from the following description, the description being used to illustrate a preferred embodiment of the invention when read in conjunction with the accompanying drawings.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
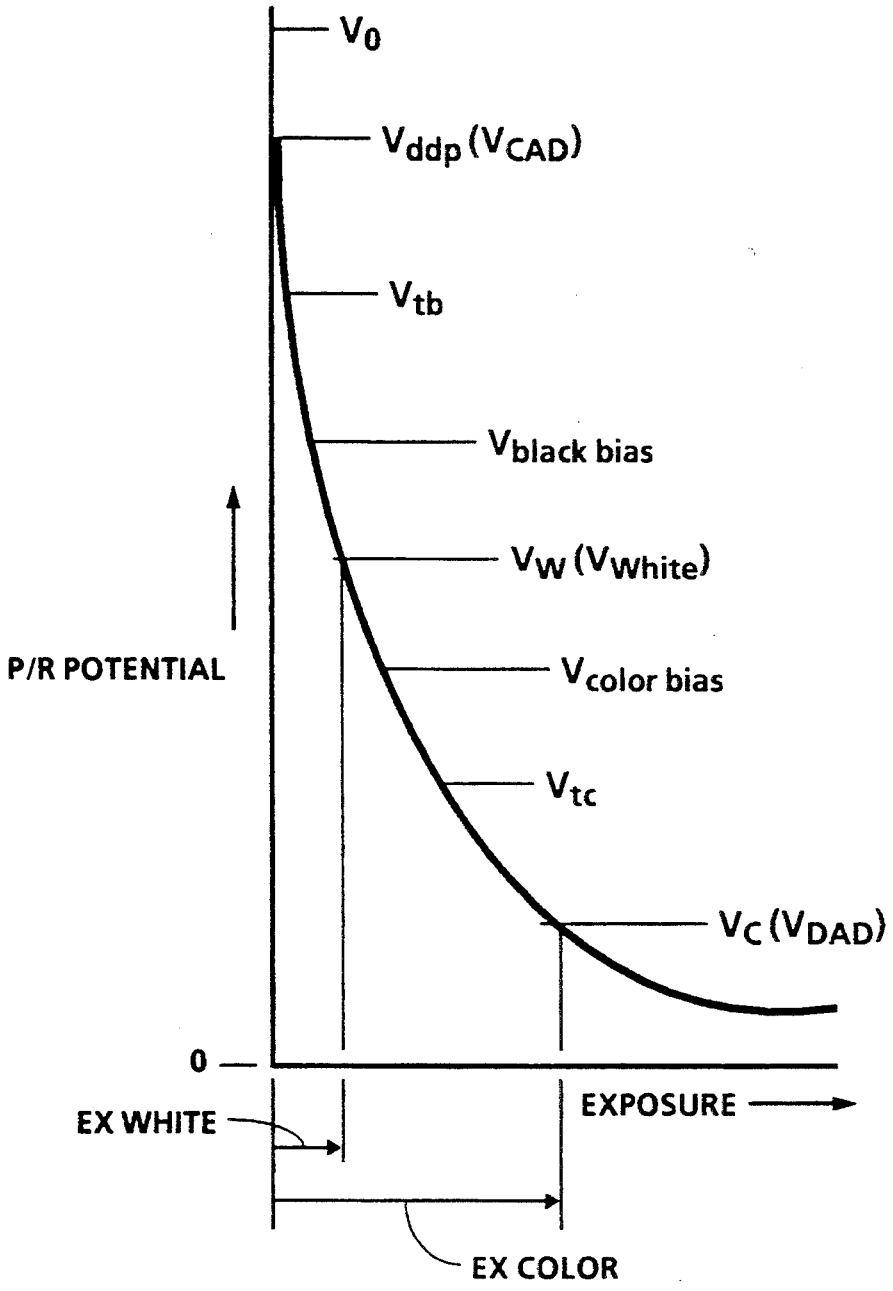
FIG. 1 PRIOR ART
FIG. 1 is a plot of photoreceptor potential versus exposure, for a tri-level electrostatic latent image.
Figure 2:
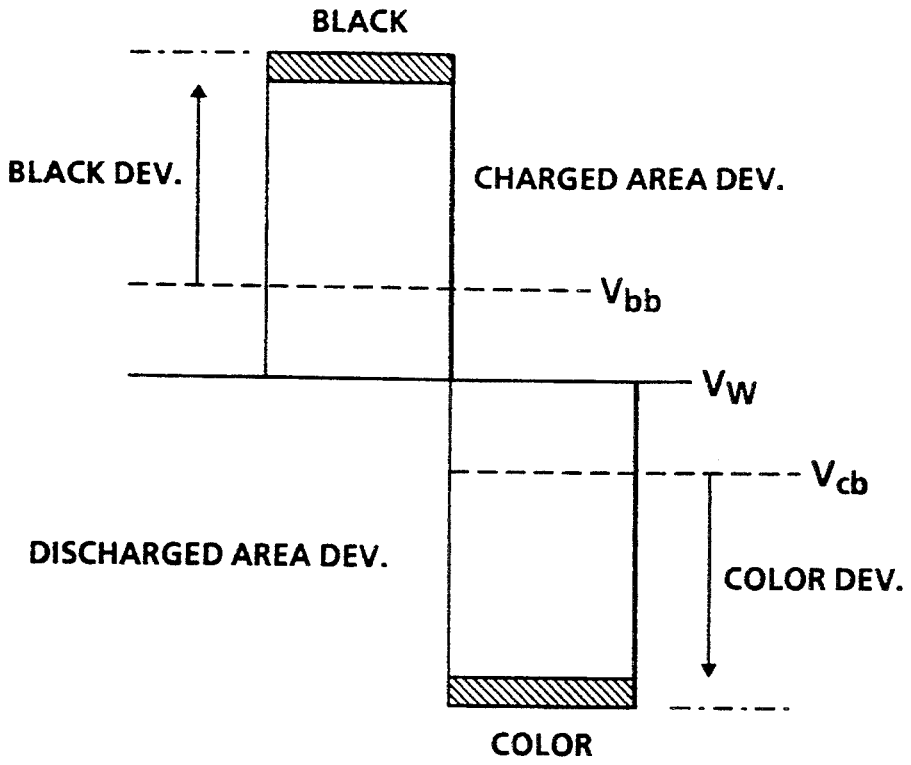
PRIOR ART FIG. 2
FIG. 2 is a plot of photoreceptor potential representing particular single-pass highlight color latent image characteristics.

Referring to FIGS. 1 and 2, the concept of tri-level highlight color imaging is described generally. For a photo-induced discharge curve ("PIDC") of FIG. 2, $V_0$ represents the initial charge level, $V_{ddp}$ ($V_{CAD}$) the dark discharge potential (unexposed), $V_{Whte}$, the white or background discharge level, and $V_c$ ($V_{DAD}$) the photoreceptor residual potential. In one example, nominal voltage magnitudes for $V_{CAD}$, $V_{White}$ and $V_{DAD}$ are 788 v, 423 v and 123 v, respectively.

In highlight color applications, color discrimination in the development of the electrostatic latent image is achieved by passing the photoreceptor, with a latent image disposed thereon, through first and second developer housings and biasing the housings to voltages which are offset from the background voltage $V_{White}$. In one illustrated embodiment, the second housing contains developer with positively charged black toner. Accordingly, the toner from the second housing is driven to the most highly charged ($V_{ddp}$) areas of the latent image by the electrostatic field between the photoreceptor and the development rolls in the second housing, the second housing development rolls being biased at $V_{black\ bias}$ ($V_{bb}$). The first housing contains negatively charged colored toner. Accordingly, the toner from the first housing is urged towards parts of the latent image at the residual potential, namely $V_{DAD}$, by the electrostatic field existing between the photoreceptor and the development rolls of the first housing, the first housing rolls being biased to $V_{color\ bias}$, ($V_{cb}$). In one example, nominal voltage magnitudes for $V_{bb}$ and $V_{cb}$ are 641 v and 294 v, respectively.

Figure 3:
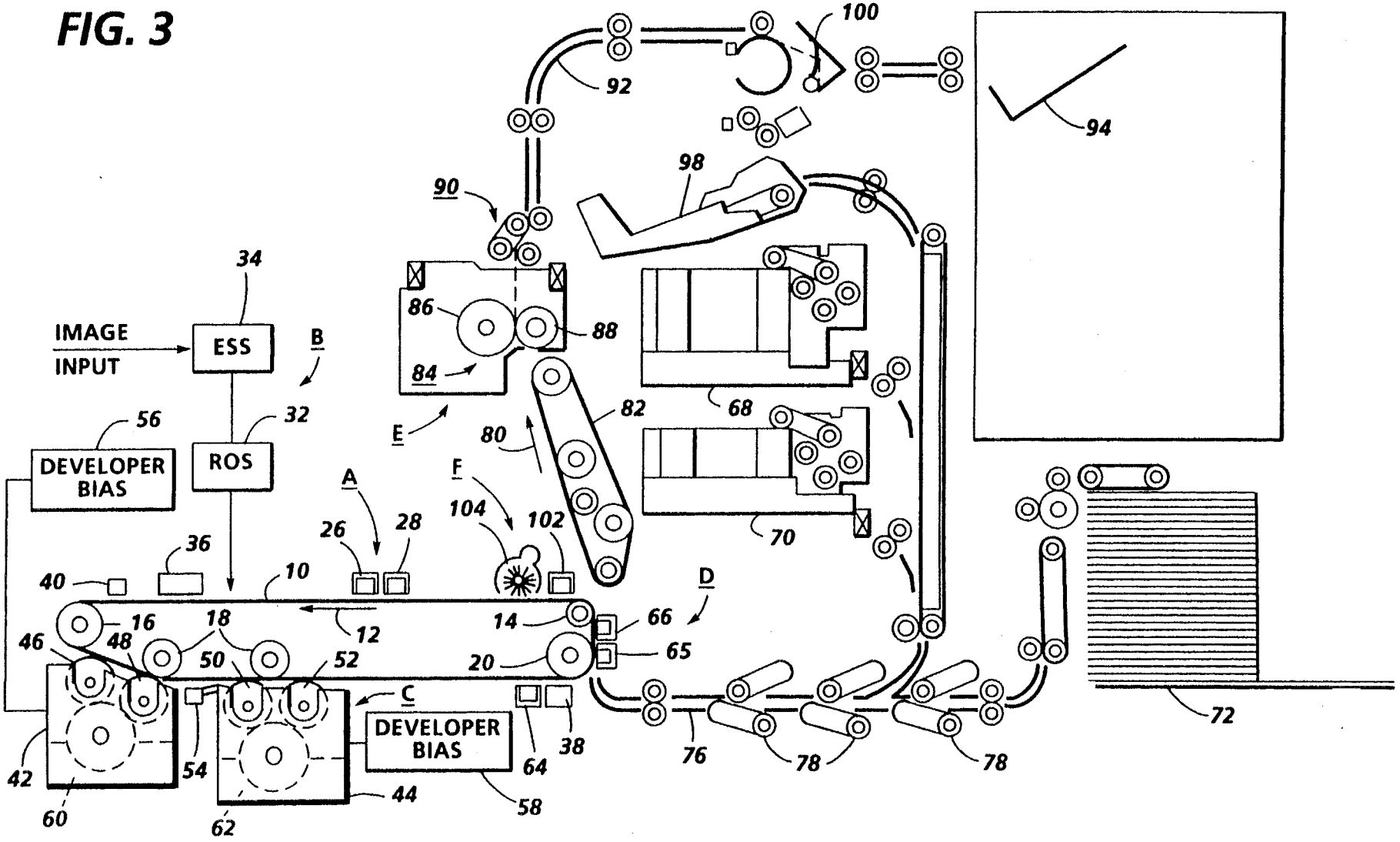
FIG. 3 is a schematic view of a printing machine with which the present invention can be employed.

Referring to FIG. 3, a reproduction machine in which the present invention finds advantageous use employs a photoreceptor belt 10 having a charge retentive surface. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive. Belt 10 is maintained in tension by a pair of springs (not shown) resiliently urging tension roller 16 against belt 10 with the desired spring force. Both stripping roller 14 and tension roller 16 are rotatably mounted. These rollers are idlers which rotate freely as belt 10 moves in the direction of arrow 12.

Figure 4:
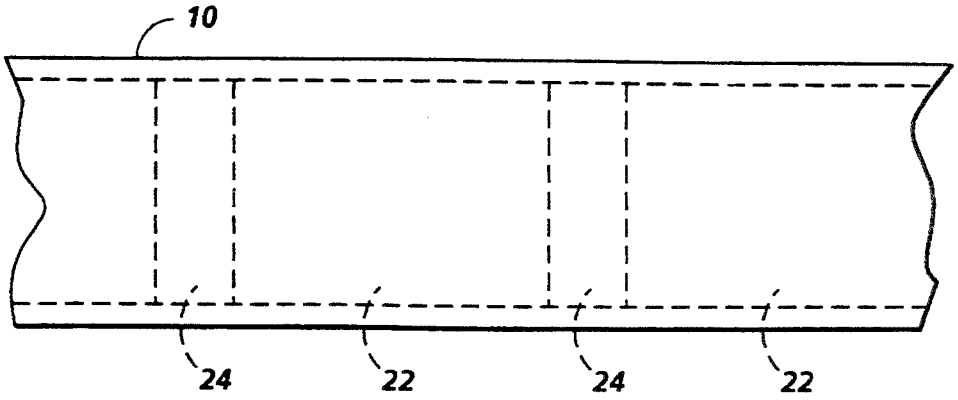
FIG. 4 is a partial plan view of a photoreceptive belt used in the printing machine of FIG. 3.

Referring to FIG. 4, in the preferred embodiment of the present invention, latent images from documents are formed respectively in document portions or zones of the charge retentive surface of the photoreceptor, each of which document zones is designated by the numeral 22. Areas interposed between the document zones 22, are referred to as interdocument zones, and are designated by the numeral 24.

Referring again to FIG. 3, portions of the belt 10 pass through charging station A. At charging station A, a pair of corona devices 26 and 28 charge successive portions 22, 24 of the photoreceptor belt 10 to a relatively high, substantially uniform negative potential.

At exposure station B, the uniformly charged photoreceptor is exposed to a laser based scanning device 32 or ROS, which, in accordance with a driving ESS 34, discharges the photoreceptor to one of three charge levels in accordance with a stored image. This records an electrostatic latent image on the belt which corresponds to the informational area contained within electronically stored original information. The ROS could be replaced with a conventional electrophotographic exposure arrangement.

In the preferred mode of operation, the charge retentive surface of the belt 10, which is initially charged to 3 voltage $V_0$, undergoes dark decay to a level $V_{ddp}$ or $V_{CAD}$ equal to about −900 volts to form CAD images. Upon being exposed at the exposure station B, the photoreceptor is discharged to $V_c$ or $V_{DAD}$ equal to about −100 v to form a DAD image which is about zero or ground potential in the highlight color parts of the image. During exposure, the charge retentive surface of the belt 10 is also discharged to $V_{White}$, the magnitude of $V_{White}$ equaling approximately 500 v 500 v in the background (white) areas.

Referring still to FIG. 3, a patch generator is designated by the numeral 36. In one example, the generator 36 comprises a conventional exposure device, and serves to record test or control patches in the interdocument zones 24, the test patches being used both in a developed and undeveloped condition for controlling various process functions. An Infra-Red densitometer (IRD) 38 is utilized to sense or measure the reflectance of test patches after they have been developed. It should be recognized that each test patch can be recorded and developed with multiple toners having differing polarities. Thus, the patch generator 36 is preferably adapted to provide different levels of exposure for any one given interdocument zone 24. A first electrostatic voltmeter ($ESV_1$) 40 is positioned downstream of the patch generator 36 for monitoring certain electrostatic charge levels (i.e. $V_{DAD}$, $V_{CAD}$, $V_{White}$, and $V_{tc}$) on various portions of the photoreceptive belt 10.

At development station C, a magnetic brush development system advances developer materials into contact with an electrostatic latent image on the photoreceptor. It will be appreciated by those skilled in the art that the term "developer material" includes, among other materials, toner. The development station C comprises a first developer housing 42 and second developer housing 44. Preferably, the housing 42 contains a pair of magnetic brush developer rollers 46, 48 while the housing 44 contains a pair of magnetic brush developer rollers 50, 52. Each pair of rollers advances its respective developer material into contact with the latent image. Appropriate developer biasing is accomplished via power supplies 56 and 58, the power supplies 56, 58 being electrically coupled with respective developer housings 42, 44. A pair of toner replenishment devices (not shown) are provided for replacing the toner as it is depleted from the developer housing structures 42, 44.

Color discrimination in the development of the electrostatic latent image is achieved by passing the photoreceptor past the two developer housings 42 and 44 in a single pass with the magnetic brush rolls 46, 48, 50 and 52 electrically biased to voltages which are offset from the background voltage $V_{White}$ in a direction depending on the polarity of toner in the housing. In the illustrated embodiment of FIG. 3 the housing 42 contains negatively charged blue conductive magnetic brush (CMB) developer 60. Accordingly, the blue toner is driven to the least highly charged areas at the potential $V_{DAD}$ of the latent images by the electrostatic development field ($V_{DAD}-V_{color\ bias}$) between the photoreceptor and the development rolls 46, 48. On the other hand, the housing 44 contains positively charged black toner 62. Accordingly, the black toner is urged towards the parts of the latent images at the most highly charged potential $V_{CAD}$ by the electrostatic development field ($V_{CAD}-V_{black\ bias}$) existing between the photoreceptor and the development rolls 50, 52. A second electrostatic voltmeter ($ESV_2$) 54 is positioned downstream of the first developer housing 42 for monitoring certain electrostatic charge levels (i.e. $V_{DAD}$, $V_{CAD}$, $V_{White}$, $V_{tb}$ and $V_{tc}$) on various portions of the photoreceptive belt 10.

Preferably, the rollers 46 and 48 are biased using a chopped DC bias via power supply 56, while the rollers 50 and 52 are biased using a chopped DC bias via power supply 58. The expression chopped DC ("CDC") bias refers to the process of alternating a developer housing between two potentials, namely a first potential roughly representing the normal bias for the DAD developer, and a second potential roughly representing a bias that is considerably more negative than the normal bias. The first potential is identified as $V_{Bias\ Low}$ while the second potential as $V_{Bias\ High}$. Further details regarding CDC biasing are provided in U.S. Pat. No. 5,080,988 to Germain et al., the pertinent portions of which are incorporated herein by reference.

Because the composite image developed on the photoreceptor consists of both positive and negative toner, a negative pretransfer dicorotron 64 is employed to condition the toner for effective transfer to a substrate using positive corona discharge. The concept of the invention would not be altered by conditioning the toner for transfer with negative corona discharge. Subsequent to providing pretransfer, belt 10 advances the developed latent image to transfer station D. At transfer station D, a sheet of support material such as a paper copy sheet is moved into contact with the developed latent images on belt 10 and a corona generating device 65 charges the copy sheet to the proper potential so that it is tacked to photoreceptor belt 10 and the toner powder image is attracted from photoreceptor belt 10 to the sheet. After transfer, a corona generator 66 charges the copy sheet with an opposite polarity to detack the copy sheet from belt 10, whereupon the sheet is stripped from belt 10 at stripping roller 14. For each interdocument zone 24 (FIG. 4), charge from the corona generators 65–66 is applied to each zone 24 as it is passed by the generators 65–66.

Sheets of support material are advanced to transfer station D from supply trays 68, 70 and 72, which supply trays may hold different quantities, sizes and types of support materials. Sheets are advanced to transfer station D along conveyor 76 and rollers 78. After transfer, the sheet continues to move in the direction of arrow 80 onto a conveyor 82 which advances the sheet to fusing station E.

Fusing station E, which includes a fuser assembly, indicated generally by the reference numeral 84, serves to permanently affix the transferred toner powder images to the sheets. Preferably, fuser assembly 84 includes a heated fuser roller 86 adapted to be pressure engaged with a back-up roller 88 with the toner powder images contacting fuser roller 86. In this manner, the toner powder image is permanently affixed to the sheet.

After fusing, copy sheets bearing fused images are directed through decurler 90. Chute 92 guides the advancing sheet from decurler 90 to catch tray 94 or a finishing station for binding, stapling, collating etc. and removal from the machine by the operator. Alternatively, the sheet may be advanced to a duplex tray 98 from duplex gate 100 from which it will be returned to the processor and conveyor 76 for receiving second side copy.

A pre-clean corona generating device 102 is provided for exposing the residual toner and contaminants (hereinafter, collectively referred to as toner) to positive charges to thereby shift the charge distribution thereon in a positive direction for more effective removal at cleaning station F. The cleaning station F further includes an electrically insulative, rotatably mounted cleaning member designated by the numeral 104. In the preferred embodiment, the member 104 is a fibrous brush in contact with the surface of the belt 10. The insulative brush is capable of being charged up during rotation, via triboelectric interaction with other cleaning members, for attracting toner(s) of the opposite polarity. Alternatively, the brush could be a conductive brush adapted to be biased for attracting toner(s) of the opposite polarity. A conductive brush suited for such cleaning is disclosed in U.S. Pat. No. 4,819,026 to Lange et al., the pertinent portions of which are incorporated by reference. In another example, two brushes could be mounted in cleaning relationship relative to the surface of the belt 10 to achieve redundancy in cleaning. It is contemplated that residual toner remaining on the charge retentive surface of belt 10 after transfer will be reclaimed and returned to the developer station C by any one of several well known reclaim arrangements.

Figure 5:
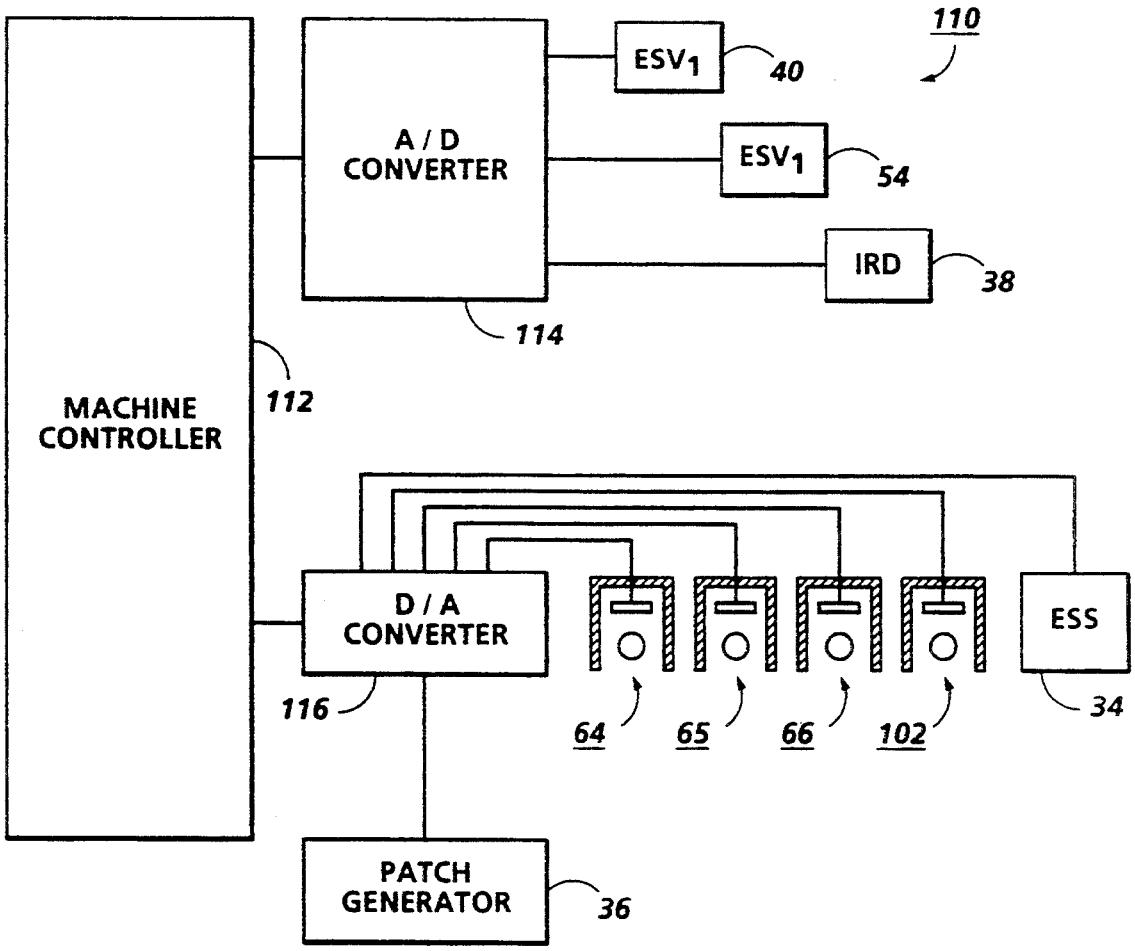
FIG. 5 is a schematic view of a control circuit used to control various components of the printing machine of FIG. 3.

Referring to FIG. 5, a control circuit for use with the above-described xerographic engine is designated with the numeral 110. In the illustrated embodiment of FIG. 5, the IRD 38, ESV1 40 and ESV2 54 are coupled with a machine controller 112 by way of an A/D converter 114, while the ESS 34, the patch generator 36 and the corona devices 64–66 and 102 are coupled with the controller 112 by way of a D/A converter 116. As will be appreciated by those skilled in the art, the machine controller 112 includes all of the appropriate circuitry for controlling the various devices coupled therewith and suitable memory for storing reference values corresponding to any measurements received from the ESV1, ESV2 or the IRD. In one embodiment the machine controller 112 could comprise a virtual machine control apparatus of the type disclosed in U.S. Pat. No. 4,475, 156 to Federico et al.

Referring still to FIG. 5, preselected current levels are respectively applied across the corona devices 64–66 and 102 during cycle-up or runtime to enable efficient transfer, detack and cleaning. That is, the respective applied current levels through the corona devices 64–65 are set to obtain optimal transfer, while the respective applied current levels through corona devices 66 and 102 are set to obtain optimal detack and cleaning.

Figure 6A:
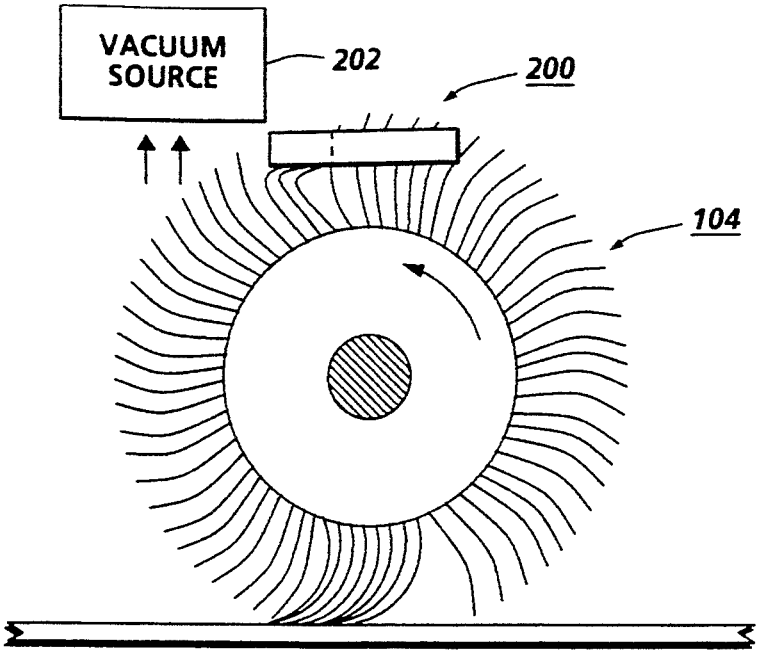
FIG. 6A is an elevational view of a cleaning brush being employed with a detoning device which embodies one aspect of the present invention.
Figure 6B:
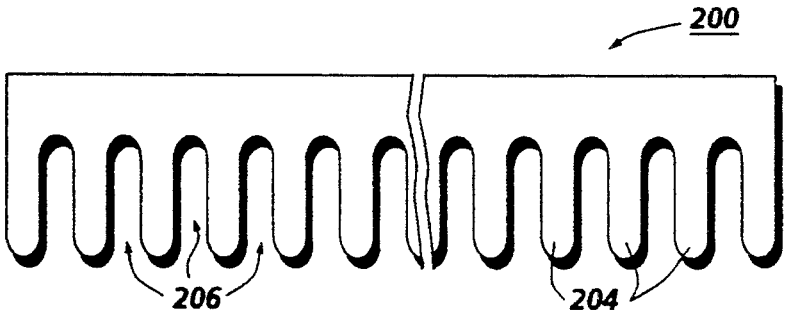
FIG. 6B is a plan view of the detoning device of FIG. 6A.
Figure 7:
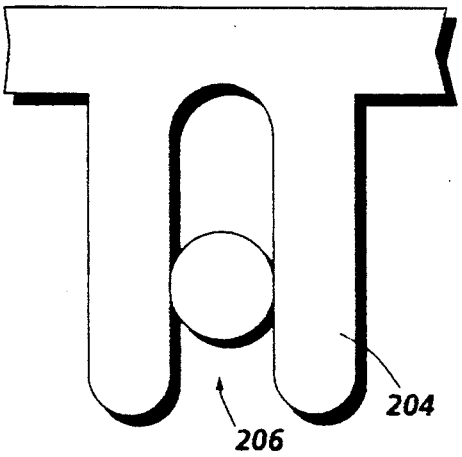
FIG. 7 is a blown up, plan, partial view of the detoning device of FIG. 6A with a cleaning brush bristle disposed between a pair of spaced teeth.

Referring to FIGS. 6A and 6B, a flicker bar, particularly suited for scraping a developer material additive, such as ZnSt and/or aerosil from the cleaning brush 104, is designated by the numeral 200. A vacuum exhaust system, represented by the box with the numeral 202, is preferably positioned over the flicker bar 200 for removing developer material, developer material additives and/or other debris removed from the cleaning brush with the flicker bar 200. In the illustrated embodiment of FIG. 6B, the flicker bar 200 comprises a comb with a plurality of teeth 204 arranged along a common axis to define a plurality of uniform spaces 206. Additionally, the comb 200 is preferably coated with or constructed form a tribo-electrically inducing substance, such as teflon ("teflon" is a trademark of), to promote cross-mixing of black toner along the cleaning brush bristles. It has been found that this cross-mixing inhibits additive filming in non-imaged and background areas of the photoreceptor. In practice, the comb 200 is superposed relative to the brush 104 so that portions of the brush bristles pass through the spaces 206 as the brush 104 is rotated. In one embodiment of the invention (FIG. 7), the teeth 204 are positioned in a manner which permits one bristle to be scraped by two adjacent teeth. In one example, the bristles have a circular transverse cross-sectional area and the width of each space 204 is approximately equal to the diameter of each bristles.

Figure 8:
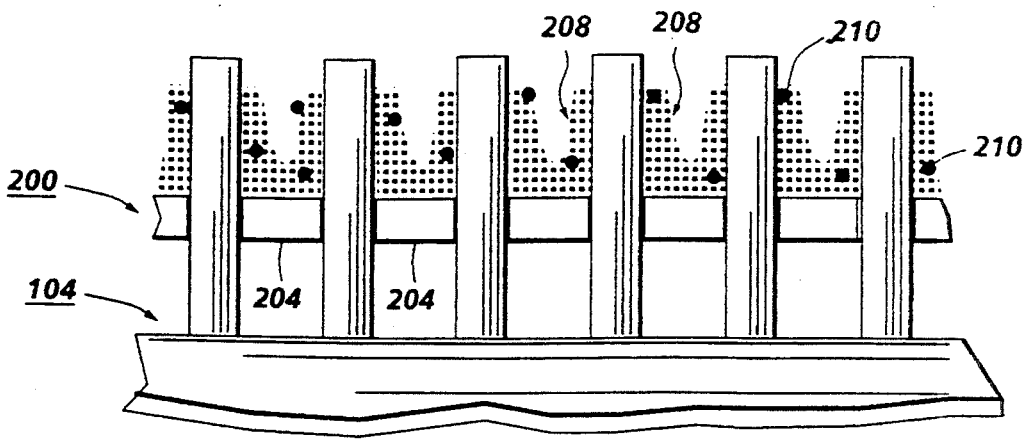
FIG. 8 is a partial, elevational view of the detoning arrangement of FIG. 6A.

Referring to FIGS. 6A and 8, the operation of the comb 200 is discussed in further detail. For a given bristle, its upper portion is moved into one of the spaces 206 and is engaged by a pair of the teeth 204. Referring specifically to FIG. 8, as the bristle is moved away from the teeth 204, developer material additives, designated by the numeral 208, and some electrostatically attached toner, designated by the numeral 210 is captured on an upper surface of the comb 200. In turn, the material captured on the comb upper surface is borne away by the vacuum exhaust system 202.

Figure 9A:
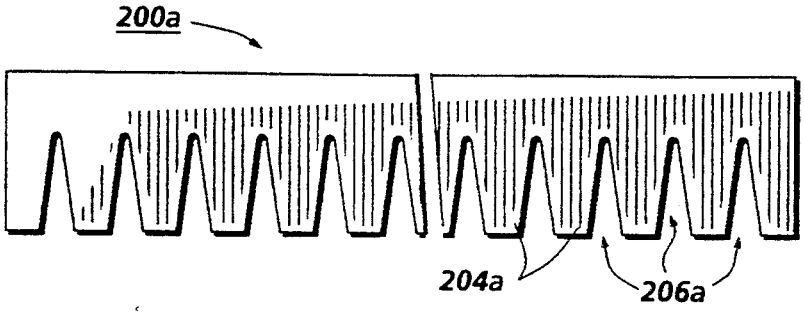
FIG. 9A is a plan view of another detoning device that can be used in the detoning arrangement of FIG. 6B.

A problem in comb design can arise as a result of variance in bristle dimensions. That is, for a given cleaning brush, the diameter of the bristles can vary, and among a group of similarly dimensioned brushes, the mean diameter can vary. Since the diameters tend to be relatively small—typically as small as 30.0 $\mu$—even minor variations in comb tooth spacing can lead to ineffective detoning. This problem can be overcome by providing a comb with variable spacing. Referring to FIG. 9A, an alternative embodiment of the comb 200 is designated by the numeral 200*a*. With the comb 200*a*, each of teeth 204 is tapered so that each spaces 206 has the appearance of a "V", as seen in a plan view. In operation, a bristle with a relatively larger diameter is engaged by a tooth pair near the opening of the V, and a bristle with a relatively smaller diameter is engaged near the vertex of the V.

Figure 9B:
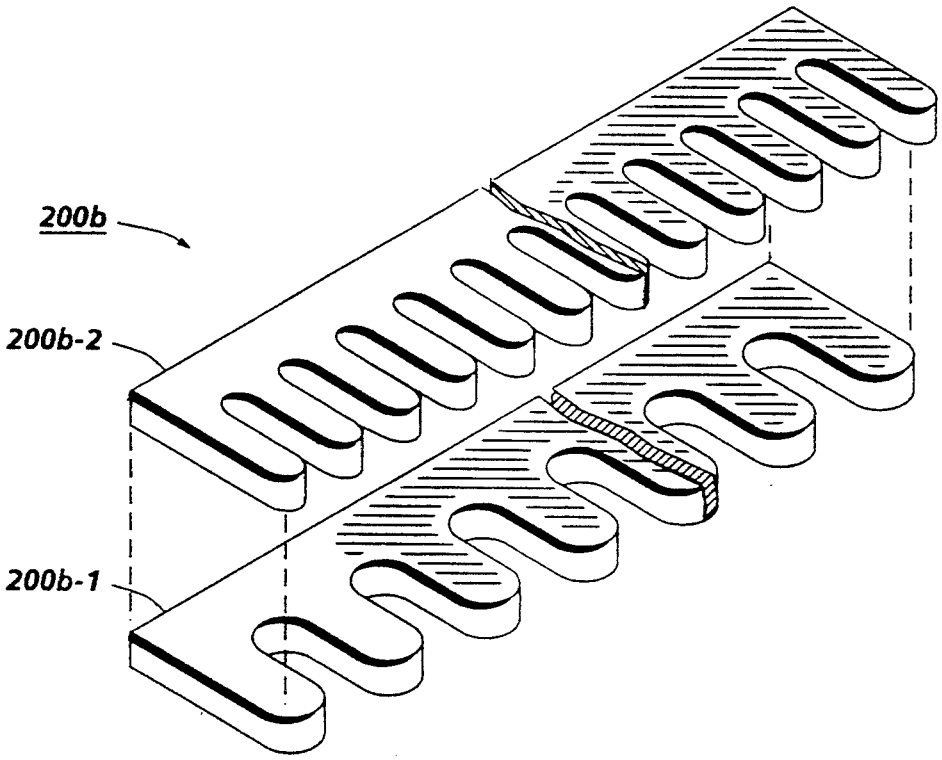
FIG. 9B is an exploded view of yet another detoning device that can be used in the detoning arrangement of FIG. 6B.

Referring to FIG. 9B, another alternative embodiment of the comb 200 is designated by the numeral 200*b*. The comb 200*b* is a composite comb which includes a plurality of combs. While the comb 200*b* is shown as a composite of combs 200*b*-1 and 200*b*-2, it could comprise more than two combs without affecting the concept upon which the composite comb is based. Preferably, the spacing between the combs is such that a suitable upper portion of a bristle with a relatively smaller diameter can pass through spaces defined by both of combs 200*b*-1 and 200*b*-2. In operation, a given bristle either passes through comb 200*b*-1 and is scraped by comb 200*b*-2, or the given bristle is scraped by comb 200*b*-1 and is precluded from entering any of the spaces in the comb 200*b*-2.

When images are developed in the document zones 22 (FIG. 4), little developer material remains on the belt 10 subsequent to transfer so that cleaning of the belt 10 is obtained by adjusting the corona device 102 and the cleaning brush 104 appropriately. When images are developed in both the document zones 22 and the interdocument zones 24, however, a problem in cleaning can arise since the developed patch in each interdocument zone is not typically removed from the belt 10 prior to cleaning. The relatively high quantity of developer material on each developed patch, which is ultimately delivered to the cleaning station F, can result in clogging or choking of the cleaning station with the excessive amount of toner. It is believed that many known detoning arrangements are not capable of handling the amounts of toner that are delivered to a cleaning station as a result of cleaning developed patches of interdocument zones.

Figure 10A:
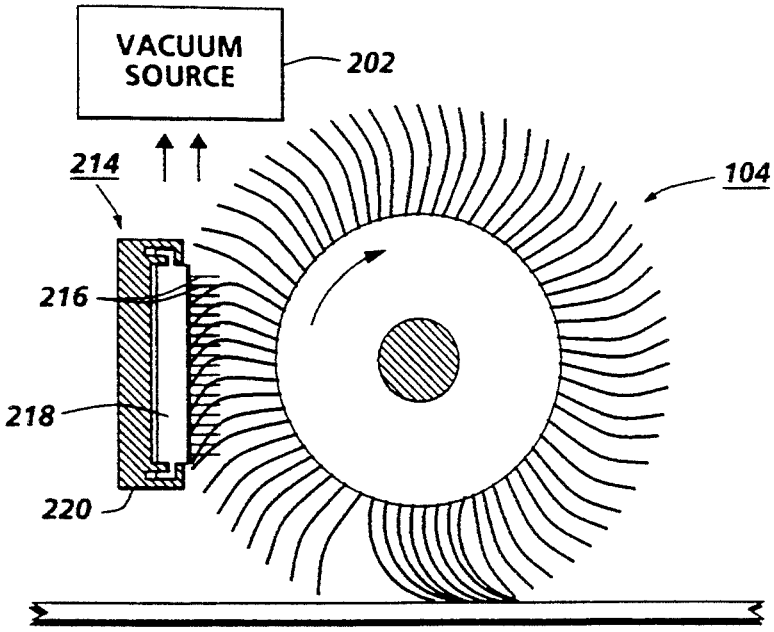
FIG. 10A is an elevational view of the cleaning brush being employed with a second detoning device which embodies another aspect of the present invention.
Figure 10B:
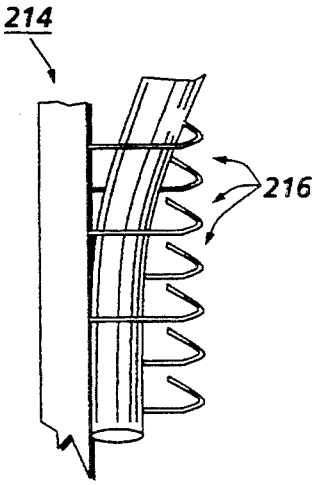
FIG. 10B is an partial, blown-up, isometric view of the detoning device of FIG. 10A.

Referring to FIGS. 10A and 10B, another detoning device, which is especially suited for facilitating removal of relatively large quantities of toner from the cleaning station F, is designated by the numeral 214. The detoning device 214 includes arrays of semi flexible or stiff bristles 216 which are mounted to a portion of the printing system by way of a substrate 218. In one example, the vacuum source 202 is mounted above the detoning device 214 for purposes of capturing particles which are dislodged from the cleaning brush 104. The detoning device 214 is positioned adjacent to the brush 104 in such a way that the fibers or bristles of the cleaning brush pass through the bristles of the detoning device so that particles adhering to the cleaning brush are dislodged from the cleaning brush. The bristles 216 are intended to interfere with and remove strongly adhering particles, from the brush 104, which are not typically removed from the fibers by normal or existing brush detoning procedures. The detoning device can be placed in tandem with normal flicker bars to further enhance fiber detone. In addition, the device can be insulative, or conductive and biased with a DC or AC voltage to optimize detone for a particular application. The detoning device 214 could likewise be made of material which satisfies triboelectric charging sequences suitable to enhance detone.

It has been found, through experimentation that the bristles of the detoning device 214 need penetrate into the cleaning brush nap only enough to detone the fiber tips of the cleaning brush 104 to a depth sufficient to maintain the cleaning function. It is envisioned that the number density of the detoning device bristles can be quite low, so long as the residence time of the cleaning fiber tips within the device is sufficient to effect detoning. The bristle arrays of the detoning device 214 should be sparse enough to enable the cleaning fiber tips to easily pass through the detoning device.

Referring to FIG. 10B, the structure of the detoning device bristles is shown at a microscopic level. Preferably, the detoning bristles are composed of a material referred to as Velcro ("Velcro" is a trademark of Velcro Industries B. V.). Microscopically the anchor part of Velcro appears as broken loops. Each of the loops appear uniformly broken to yield a straight bristle and a counterpart shaped like a "fish-hook" Each bristle is relatively stiff so as not to be deflected when in contact with the rotating cleaner fibers. In one example, the broken loops are arranged in a series of straight rows 1 mm apart—center-to-center separation along the rows is ~1 mm. The length of the bristles may also be ~1 mm and the bristle diameter may be ~0.1 mm.

Figure 11:
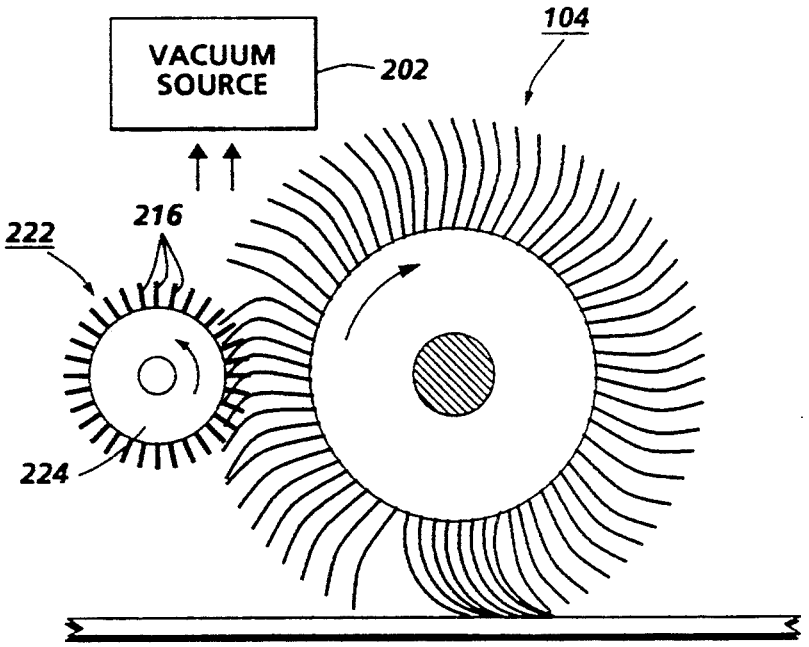
FIG. 11 is an elevational view of another detoning device that can be used with the detoning arrangement of FIG. 10A.

In the above embodiment, the detoning device 214 is shown as being mounted to a portion 220 of the reproduction machine; however, as shown in FIG. 11, the detoning device 214 could be embodied in a rotating device, namely rotating brush 222. Preferably, the detoning brush 222 includes a plurality of the hook-like members 216 mounted to a core 224. It is believed that the rotating action of brush 222 can assist in detoning and further promote material throughput.

Numerous features of the present invention will be appreciated by those skilled in the art:

One feature of the disclosed embodiment resides in the use of a first detoning device, with hook-like members, the hook-like members facilitating the detoning of developer material from a cleaning brush. The first detoning device not only alleviates choking of developer material in a cleaning station, but is compatible with existing technology, promotes system reliability and has the potential of maximizing developer material throughput.

Another feature of the disclosed embodiment is that the first detoning device is easy to fabricate and then use in its intended environment. In particular, the first detoning device is installed readily in the cleaning station. Moreover, after the first detoning device has reached the end of its useful life, it can be replaced easily.

Yet another feature of the disclosed embodiment resides in the use of a second detoning device comprising one or more combs, each comb having a plurality of spaced teeth. In operation, the teeth serve to scrape developer material and developer material additives from bristles of the cleaning brush. In a first example, each pair of teeth is spaced in a manner which causes each bristle to be scraped singularly by a pair of teeth. In a second example, the bristles have varying cross sections, characterized by respective diameters, and the teeth are tapered, so that the spaces between the teeth vary in width. Accordingly, in this second example, the second detoning device is capable of scraping developer material and developer material additives from bristles of varying diameters. In a third example, the comb comprises a composite comb which is also capable of scraping developer material and developer material additives from bristles of varying diameters.

As should be appreciated, the second detoning device permits maximization of developer material additive throughput and eliminates the need for lengthy and expensive materials modification. Additionally, the second detoning device provides a hardware solution to complex materials issues.

What is claimed is:

1. A cleaning apparatus for removing residual developer material remaining on a surface of a printing machine, comprising:

a movable cleaning brush having bristles extending therefrom and being positioned adjacent the surface so that, when said movable cleaning brush is moved, said bristles are brought into contact with the surface for removing the residual developer material therefrom; and a detoning device being positioned immediately adjacent said movable cleaning brush so that portions of said movable cleaning brush are brought selectively into contact with said detoning device as said movable cleaning brush is moved, said detoning device including a plurality of flexible hook-like members which selectively engage respective portions of said bristles, as said movable cleaning brush is moved, to dislodge residual developer material from said respective bristle portions as the portions of said movable cleaning brush are brought selectively into contact with said detoning device, said dislodging causing the residual developer material to be scrapped from said respective bristle portions for circumferentially cleaning said same.

2. The cleaning apparatus of claim 1, further comprising a substrate, said flexible hook-like members being mounted on said substrate.

3. The cleaning apparatus of claim 1, wherein said detoning device is mounted to a portion of the printing machine so that said detoning device is stationary relative to said moveable cleaning brush.

4. The cleaning apparatus of claim 3, wherein said detoning device is releasably mounted to the printing machine portion, so that said detoning device can be replaced readily.

5. The cleaning apparatus of claim 1, wherein said flexible hook-like members are substantially shorter than said bristles.

6. The cleaning apparatus of claim 1, further comprising a vacuum source, positioned adjacent to said flexible hook-like members, for removing the residual developer material therefrom.

7. The cleaning apparatus of claim 1, wherein said flexible hook-like members are arranged in rows with each bristle moving through a substantial portion of the rows.

8. The apparatus of claim 1, wherein said plurality of flexible hook-like members comprise conductive flexible hook-like members adapted to be electrically biased with an electrical signal to assist in removing the residual developer material from said movable cleaning member.

9. The apparatus of claim 1, wherein said movable cleaning brush is rotatable; and said detoning device is rotatable so that it can be rotated relative to said rotatable cleaning brush.

10. The apparatus of claim 1, wherein said plurality of flexible hook-like members comprise flexible hook-like members adapted to be tribo-electrically charged for removing the residual developer material from said movable cleaning brush.

11. The apparatus of claim 1, wherein said detoning device includes a detoning member which is separate from said plurality of flexible hook-like members, said detoning member supplementing the removal of residual developer material from said movable cleaning brush.

12. A cleaning apparatus for removing residual developer material remaining on a surface of a printing machine, comprising:

a movable cleaning brush positioned adjacent to the surface so that, when said movable cleaning brush is moved, said movable cleaning brush is brought into contact with the surface for removing the residual developer material from the surface, said movable cleaning brush having a first set of bristles and a second set of bristles, with each of the first set bristles having a first characteristic dimension and each of the second set bristles having a second characteristic dimension, the first characteristic dimension being different than the second characteristic dimension;

a detoning device, positioned adjacent to said movable cleaning brush, in a manner that permits said movable cleaning brush bristles to contact said detoning device as said movable cleaning brush is moved, said detoning device being configured to engage portions of each of said first set bristles, for removing residual developer material therefrom, and portions of each of said second set bristles, for removing residual developer material therefrom; and wherein, said detoning device includes a comb with a plurality of teeth arranged in a manner which defines a series of spaces disposed along a common axis, said teeth being spaced from one another by a width with said teeth being tapered so that the width varies, each tooth includes a pair of first edge locations and a pair of second edge locations with each first edge location being spaced from one of the second edge locations, and portions of the first set bristles are engaged between first edge locations to scrape residual developer material therefrom and portions of the second set bristles are engaged between second edge locations to scrape residual developer material therefrom.

13. A cleaning apparatus for removing residual developer material remaining on a surface of a printing machine, comprising:

a movable cleaning brush positioned adjacent to the surface so that, when said movable cleaning brush is moved, said movable cleaning brush is brought into contact with the surface for removing the residual developer material from the surface, said movable cleaning brush having a first set of bristles and a second set of bristles, with each of the first set bristles having a first characteristic dimension and each of the second set bristles having a second characteristic dimension, the first characteristic dimension being different than the second characteristic dimension;

a detoning device, positioned adjacent to said movable cleaning brush, in a manner that permits said movable cleaning brush bristles to contact said detoning device as said movable cleaning brush is moved, said detoning device being configured to engage portions of each of said first set bristles, for removing residual developer material therefrom, and portions of each of said second set bristles, for removing residual developer material therefrom; and wherein said detoning device includes, a first comb with a plurality of teeth arranged in a manner which defines a first series of spaces disposed along a common axis, and a second comb with a plurality of teeth arranged in a manner which defines a second series of spaces defined along an axis, wherein each of the spaces in the first series of spaces has a first width and each of the spaces in the second series of spaces has a second width, wherein the first width is different from the second width.

* * * * *